US006439856B1

(12) United States Patent
Ivey

(10) Patent No.: US 6,439,856 B1
(45) Date of Patent: Aug. 27, 2002

(54) INLINE STROKE COUNTER FOR AIR PUMPS

(75) Inventor: Kenneth C. Ivey, Castle Rock, WA (US)

(73) Assignee: SEH America, Inc., Vancouver, WA (US)

( * ) Notice: Subject to any disclaimer, the term of this patent is extended or adjusted under 35 U.S.C. 154(b) by 0 days.

(21) Appl. No.: 09/704,416

(22) Filed: Nov. 1, 2000

(51) Int. Cl.[7] ..... F04B 49/00
(52) U.S. Cl. ..... 417/63; 73/715
(58) Field of Search ..... 417/63, 44.1, 44.2; 73/715, 716, 717

(56) References Cited

U.S. PATENT DOCUMENTS

| | | | | |
|---|---|---|---|---|
| 3,976,989 A | | 8/1976 | Smith | |
| 4,432,248 A | * | 2/1984 | Lalin | 73/864.03 |
| 4,858,478 A | * | 8/1989 | Kush et al. | 73/864.35 |
| 5,371,720 A | * | 12/1994 | Cuomo | 367/149 |
| 5,419,191 A | * | 5/1995 | Niehaus et al. | 73/264 |
| 5,517,008 A | | 5/1996 | Francart, Jr. | |
| 5,547,345 A | * | 8/1996 | North, III et al. | 417/63 |
| 5,549,157 A | * | 8/1996 | Johnson et al. | 166/105 |
| 5,672,050 A | * | 9/1997 | Webber et al. | 417/18 |
| 5,713,723 A | * | 2/1998 | Hathaway | 417/63 |
| 6,016,688 A | * | 1/2000 | Hiss, III et al. | 73/28.01 |

OTHER PUBLICATIONS

Omron's Comapact New Totalizers, Model H7EC Self–Power Counter, http://ocieb.omron.com/oci/PR–H7E.htm, http:/www.omron–ap.co . . . g/htm/counter_h7ec _01oct2000.htm.*

* cited by examiner

*Primary Examiner*—Louis J. Casaregola
*Assistant Examiner*—Han L Liu
(74) *Attorney, Agent, or Firm*—Kurt M. Rilander, Esq.

(57) ABSTRACT

A novel method for counting pump cycles of an air pump by detecting the air pressure differential of the air pump cycle with a differential pressure switch and attaching an electronic counter to the pressure switch to count the number of openings and /or closings detected by the pressure switch.

7 Claims, 1 Drawing Sheet

INLINE STROKE COUNTER FOR AIR PUMPS

FIELD OF THE INVENTION

The instant invention relates to cycle counters for pneumatic pumps and more particularly to cycle counters for air pumps.

BACKGROUND

Pumps have a finite life. Preventative maintenance extends the finite lifespan of pumps used in manufacturing processes. Identifying the number of pump cycles in the life of a pump aids in the scheduling of preventative maintenance for pumps.

Known methods of counting pump cycles in operation are limited to magnetic counters with a magnet in the pump operation that detects changes in magnetic flux through the operation of the pump, magnetic sensors detecting changes in magnetic flux through operation of the pump, and mechanical counters where a gear driven mechanical counter is attached to a cyclic switch actuator. Disadvantages of existing methods and articles of counting pump cycles include an involved installation effort. Similarly, in the case of magnetic counters, disadvantages include the need to invasively insert an object inside the pump. Existing methods and devices also require modification of the pump itself in the installation effort. Existing methods further limit selections of the pump to particular pump styles and/or pump manufacturers. Finally, with existing method, selection of the pump itself may be limited to one manufacturer or style.

The following represents a list of known related art:

U.S. Pat. No. 5,549,157 (Johnson et al) discloses an electronic counter with a pump mounted sensor for cycle indication to count pump cycles. The citation teaches the insertion of a magnet inside the pump in conjunction with a magnetic sensor outside the pump that detects magnetic flux for purposes of counting pump cycles.

U.S. Pat. No. 5,517,008 (Francart) discloses a steam powered liquid pump mechanical cycle counter. The citation teaches a gear driven mechanical counter that manually increases a count number in response to the mechanical response of a diaphragm to pressure differential.

U.S. Pat. No. 3,976,989 (Smith) discloses an electronic pressure cycle indicator. The citation teaches an electronic device for indicating for alarm purposes the open and closed state of a pump in response to diaphragm signals. The device includes mention of an "counter/timer" that is used for purposes of timing the alarm action and that is automatically reset every time the pump is shut down for a predetermined period.

The teachings of each of the above-listed citations (which does not itself incorporate essential material by reference) are herein incorporated by reference. None of the above inventions and patents, taken either singularly or in combination, is seen to describe the instant invention as claimed. Thus solving the aforementioned problems is desired.

Heretofore, application of methods and articles for counting pump cycles for purposes of scheduling periodic maintenance and scheduling the useful life of pneumatic pumps through use of an inline stroke counter has never been performed.

Therefore, it is highly desirable to create methods and articles for counting pump cycles through use of an inline stroke.

SUMMARY

Accordingly, it is an object to provide novel methods for solving the above-mentioned problems. In particular, it is an object to provide novel methods for electronically counting pressure cycles using a differential pressure switch and an electronic counter.

These and other objects and advantages are achieved by methods for connecting an electronic counter to a differential pressure switch.

The novel methods provide a number of advantages, including the simplicity and ease of making the inline stroke counter and the ability to count strokes inline without the need for taking the pump apart to insert foreign bodies. Commercially available equipment may be used.

The novel methods of the present invention are well suited for use in connection with manufacturing silicon wafers and with manufacturing processes in general that use pneumatic pumps and that have a need to maintain pneumatic pumps.

Advantage further obtains from the ease of installation of the present invention as compared to existing methods. Advantage obtains from obviation of any need to invasively insert an object inside the pump. Advantage obtains from the quality that the present invention can be attached to the pump airline without affecting performance of the pump. Advantage obtains from the obviation of any need to modify the pump itself. Advantage obtains because the present invention is not limited in applicability to particular pneumatic pump styles or manufacturers.

Further benefits and advantages of the embodiments of the invention will become apparent from consideration of the following detailed description given with reference to the accompanying drawings, which specify and show preferred embodiments of the present invention.

The accompanying drawings, which are incorporated in and constitute a part of this specification, illustrate one embodiment of the invention and, together with the description, serve to explain the principles of the invention.

The novel articles and methods provide a number of advantages. The present invention allows a quick and easy way to attach and utilize a cycle counter for pneumatic pumps. The present invention allows use of a standard off the shelf electronic counter, easily connected to a standard off the shelf differential pressure switch, to count pneumatic pump cycles. The novel articles and methods of the invention are well suited for use in pneumatic pumps.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

DETAILED DESCRIPTION

Figure 1:
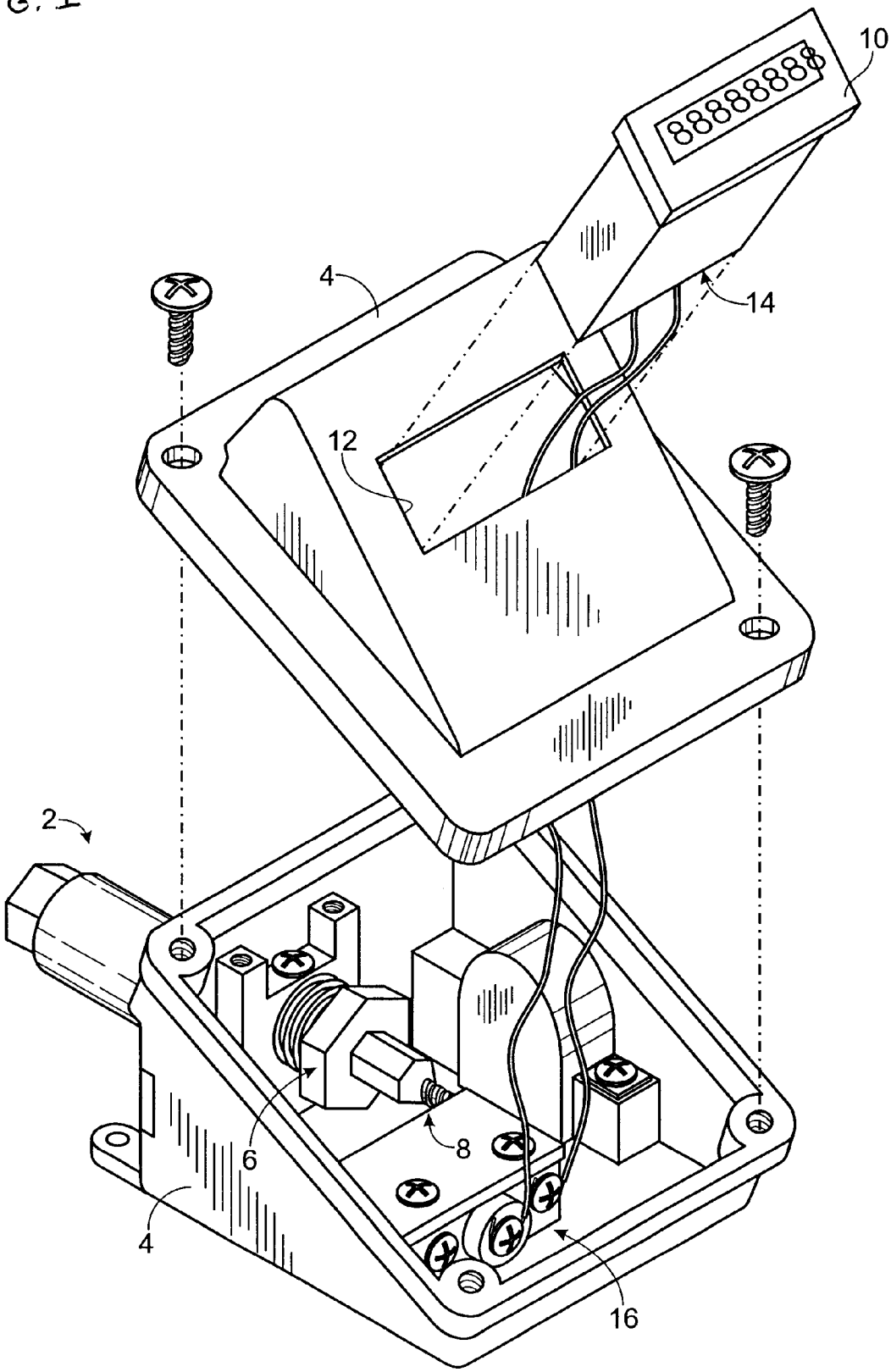
FIG. 1 depicts a partially exploded perspective view of an embodiment of the present invention.

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy. An attempt has been made specifically to point out any dimensions, tolerances, etc., which are important.

Turning now to a discussion of the present invention, an inline stroke counter for air pumps is depicted in FIG. 1 and comprises a differential pressure switch and an electronic counter connected to the pressure switch by wires.

Referencing FIG. 1, the differential pressure switch includes a housing (4), diaphragm element (6), and signal element (8). The diaphragm element that responds to air pressure cycles and a signal element that converts mechanical signals from the diaphragm to electronic signals indicating when the air pressure cycle is open and closed. The diaphragm element transmits the mechanical signal of an air pressure cycle from the air pump to the battery operated signal element within the pressure switch housing. Pressure switches are commercially available under the trade name 100 Series from United Electric Controls Company, of Watertown, MA. The differential pressure switch other than in terms of the structural combination forming the inline stroke counter is not the Applicants' invention. In the preferred embodiment, the differential pressure switch has an operating range of 10 to 100 psi.

As shown in FIG. 1, the electronic counter (10) is connected to the pressure switch by cutting a hole (12) in the pressure switch housing, and connecting terminals (14) on the electronic counter to terminals (16) on the signal converter by standard electric wires Acceptable electronic counters are well known in the field, and include those commercially available under the trade name H7EC-N-B Total Counter from the Omron Corporation of Japan. Those skilled in the art will know to connect counter terminals of the electronic counter to the common and open terminals of the pressure switch signal converter. The electronic counter other than in terms of the structural combination forming the inline stroke counter is not the Applicant's invention. In the preferred embodiment, the electronic counter is battery operated and receives signals in the range of 1 kHz to 30 Hz.

In operation, the differential pressure switch connector (2) is connected inline to an air pump. The differential pressure switch generates open and closed signals in response to differential air pressure generated by the pump action. The electronic counter counts the signals.

It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are also possible, their specific designs depending upon the particular application. As such, the scope of the invention should not be limited by the particular embodiments herein described but should be defined only by the appended claims and equivalents thereof.

I claim:

1. An inline stroke counter for air pumps, comprising:

a. a differential pressure switch connectable to an pneumatic pump; and b. an electronic counter connected to the pressure switch for counting pressure cycles, wherein the electronic counter receives electronic signals in the range 1 kHz to 30 Hz.

2. An inline stroke counter for air pumps, comprising:

a. a differential pressure switch connectable to a pneumatic pump, said pressure switch comprised of a housing, a diaphragm element, and a signal converting element with terminals; and b. an electronic counter mounted on the pressure switch through a hole in the pressure switch housing, and connected to the signal element by wires, wherein the electronic counter receives electronic signals in the range 1 kHz to 30 Hz.

3. The inline stroke counter of claims 1 or 2, wherein the pressure switch has an operating range of 10 to 100 psi.

4. The inline stroke counter of claims 1 or 2, wherein the electronic counter is battery operated.

5. A method of electronically counting air cycles of a pneumatic, comprising the steps of:

a. Generating electronic signals in response to differential air pressure in a pneumatic pump cycles with a differential pressure switch;

b. Transmitting said signals to an electronic counter; and c. Counting the number of said signals using an electronic counter connected to the differential pressure switch. wherein the electronic counter receives electronic signals in the range 1 kHz to 30 Hz.

6. The method of electronically counting cycles of claim 5, wherein the differential pressure switch has an operating range of 10 to 100 psi.

7. The method of electronically counting cycles of claims 5 or 6, wherein the electronic counter is battery operated.

* * * * *